US007170337B2

(12) United States Patent
Whittaker

(10) Patent No.: US 7,170,337 B2
(45) Date of Patent: Jan. 30, 2007

(54) LOW VOLTAGE WIDE RATIO CURRENT MIRROR

(75) Inventor: Edward J. W. Whittaker, Bishop's Stortford (GB)

(73) Assignee: SiGe Semiconductor (U.S.), Corp., Ottawa (CA)

( * ) Notice: Subject to any disclaimer, the term of this patent is extended or adjusted under 35 U.S.C. 154(b) by 0 days.

(21) Appl. No.: 10/827,239

(22) Filed: Apr. 20, 2004

(65) Prior Publication Data

US 2005/0231273 A1 Oct. 20, 2005

(51) Int. Cl.
*G05F 3/26* (2006.01)

(52) U.S. Cl. ..... 327/542; 323/316

(58) Field of Classification Search ..... 327/108, 327/530, 538, 540, 541, 542; 323/315, 316
See application file for complete search history.

(56) References Cited

U.S. PATENT DOCUMENTS 5,563,502 A * 10/1996 Akioka et al. ..... 323/313
5,703,497 A * 12/1997 Min ..... 326/33
6,344,769 B1 * 2/2002 Giuroiu ..... 327/538
6,472,858 B1 * 10/2002 Tanase ..... 323/315
6,566,852 B2 * 5/2003 Tagami et al. ..... 323/316
6,741,119 B1 * 5/2004 Aude et al. ..... 327/543

FOREIGN PATENT DOCUMENTS

EP 1 213 636 A2 11/2001

* cited by examiner

*Primary Examiner*—Timothy P. Callahan
*Assistant Examiner*—Terry L. Englund
(74) *Attorney, Agent, or Firm*—Kenyon & Kenyon LLP

(57) ABSTRACT

A low voltage wide ratio current mirror circuit comprises an n times current mirror having an input port for receiving an input current and an m times current mirror coupled in series to the n times current mirror for resulting in an output current of (N*M the input current) being provided to a load where at least one of N and M is other than 1. The circuit provides precision in output current for use with a low voltage power amplifier without incurring an overhead of quiescent current. The low voltage wide ratio current mirror circuit in accordance with a second embodiment of the invention includes a voltage swing reduction circuit in order to provide increased stability thereto. In additional embodiments of the invention, the load is a differential amplification stage for providing differential amplification to differential RF input signals received at first and second RF input ports thereof.

15 Claims, 4 Drawing Sheets

LOW VOLTAGE WIDE RATIO CURRENT MIRROR

FIELD OF THE INVENTION

The invention relates to the field of current mirror circuits and more specifically to the field of current mirror circuits for operating at low voltages.

BACKGROUND OF THE INVENTION

Current sources made by using active devices have come to be widely used in analog integrated circuits for both biasing elements as well as load devices for amplifier stages. The use of current sources in biasing can result in superior insensitivity of circuit performance to power supply variations and to temperature. When used as a load element in transistor amplifiers, the high incremental resistance of the current source results in high voltage gain at low power-supply voltages.

Current mirror circuits are typically used for generating an accurate large current from a small reference current. Current mirror circuits that operate at low supply voltages must be able to generate the accurate larger current when the supply voltage is less than twice a base emitter voltage drop (Vbe) for a bipolar transistor or when the supply voltage is less than twice a threshold voltage (Vt) for a FET device. These low supply voltages can occur in devices that operate using two 0.9V battery cells, such as mobile terminals.

A prior art patent, EP 1 213 636 describes a current mirror circuit. Unfortunately, this circuit does not allow wide ratio operation and is more difficult to stabilize. The current ratio is limited to the ratio of the NPN devices used. Loop stability is harder to achieve since it is difficult to achieve one dominant loop pole. Stability in the current mirror is known to those of skill in the art to be an important quality for the current mirror circuit because of the potential to introduce oscillations that disrupt the operation of the load circuit. Wide ratio current mirrors are often used with power amplifier circuits and the wide ratios required by these PAs are not attainable by other means. Utilizing a low ratio current mirror would result in appreciable wasted current consumption by virtue of the fact that the bias circuits would have to provide much greater input currents. In other words, the current being 'mirrored' becomes a more significant fraction of the current being supplied to the load. When the mirror output transistor is modulated with a large amplitude RF signal another disadvantage of this scheme becomes apparent, particularly where a large mirror ratio is chosen. The RF signal causes an increase in the mean collector current in the modulated transistor and therefore an increase in the mean base current. This is because the transistor is biased into class B operation. This mean base current is sourced from the current mirror not from the RF source and is usually significantly larger than the quiescent component. Thus a large RF signal can reduce the effective mirror ratio.

Other solutions that incorporate operational amplifiers (OpAmps) are also known to those of skill in the art, however these circuits are quite complex and often less accurate. An Opamp, on its own, is inherently more complex than simple transistor circuits. OpAmp circuits are subject to voltage offset, which can be an issue when we are dealing with NPN current mirror circuits where a few mV represents a significant error term. They typically are not able to operate at 1.5V. Other conventional current mirror circuits also have difficulties operating with large ratios.

A need therefore exists for a wide ratio current mirror for offering stable operation at low supply voltages. It is therefore an object of the invention to provide a wide ratio and low voltage current mirror that offers stability at low supply voltages. It is a further object of the invention to provide low voltage current mirror for use with a differential amplification stage.

SUMMARY OF THE INVENTION

In accordance with the invention there is provided a circuit comprising: a first supply voltage port; a second supply voltage port; a current mirror circuit comprising a first current mirror port and a second current mirror port, the second current mirror port for propagating an input current from the first supply voltage port to the second supply port through the current mirror circuit coupled therebetween, where the first current mirror port is for providing N times the input current; and, a current ratioing circuit comprising a first portion disposed between the first current mirror port and the second supply voltage port and a second portion disposed between the first supply voltage port and the second supply voltage port, the second portion comprising a load current path, where the current ratioing circuit is for propagating M times N times the input current through the load current path.

In accordance with the invention there is provided a method comprising: providing a current mirror circuit having a first mirror portion and a second mirror portion, the first portion for propagating N times more current than the second portion; providing a current ratioing circuit having a first portion and second portion, the second portion for propagating M times more current than the first portion; propagating of an input current through a second portion of the current mirror circuit; mirroring of the input current in the first portion to provide N times the input current; receiving of the N times the input current by the current ratioing circuit; and, ratioing of the N times the input current so that N times the input current propagates through the first portion and M times N times the input current propagates through the second portion.

BRIEF DESCRIPTION OF THE DRAWINGS

Exemplary embodiments of the invention will now be described in conjunction with the following drawings, in which.

DETAILED DESCRIPTION OF EMBODIMENTS OF THE INVENTION

Figure 1:
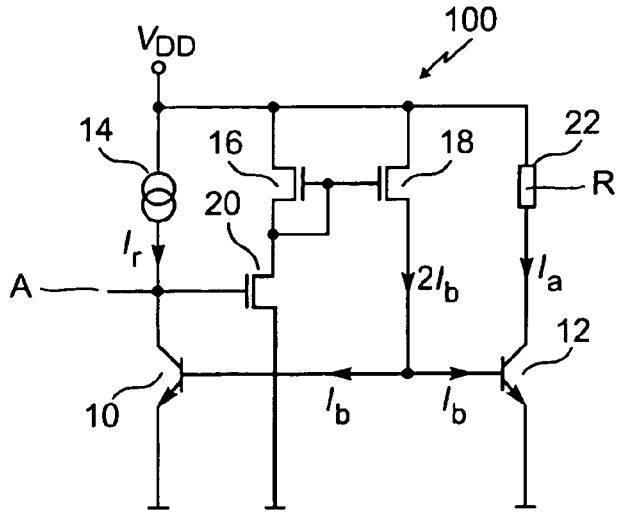
Fig. 1 (PRIOR ART)
FIG. 1 illustrates a prior art current mirror circuit.

Referring to prior art FIG. 1, disclosed in EP 1,213,636, a current mirror circuit 100 is shown comprising two bipolar transistors 10 and 12 as well as the current source 14 for providing a reference current (Ir). An output current (Ia) for being generated by the current mirror circuit 100 propagates through load resistor R 22.

The current mirror circuit 100 comprises a further current mirror circuit that includes two p-channel MOS field-effect transistors 16 and 18 as well as an n-channel MOS field-effect transistor 20 that receives Ir from the current source 14 through its gate terminal. Gate terminals of the p-channel MOS field-effect transistors 16 and 18 are connected to each other and their source terminals are connected to a positive supply voltage port for receiving the supply voltage VDD. The drain of the p-channel MOS field-effect transistor 16 is connected to the gate terminals of these two MOS transistors 16 and 18. Furthermore, the drain of the p-channel MOS field-effect transistor 16 is connected to the drain of the n-channel MOS field-effect transistor 20, with a source terminal thereof directly connected to ground. The potential on the gate terminal of NFET 20 rises until sufficient current flows in the base of NPN transistor 10 to allow the collector current of NPN transistor 10 to match the current from the current source 14. Since NFET 20 draws no gate current this match is exact—independent of the current being drawn by the base of NPN 12.

Furthermore, the current mirror circuit of prior art FIG. 1 does not allow wide ratio operation and is more difficult to make stable. The current ratio is limited to the ratio of the NPN devices used. A practical limit to the ratio is perhaps 20 to 40 times a maximum current ratio in order to attain proper matching. Stability is harder to achieve since it is difficult to achieve one dominant loop pole.

Figure 2:
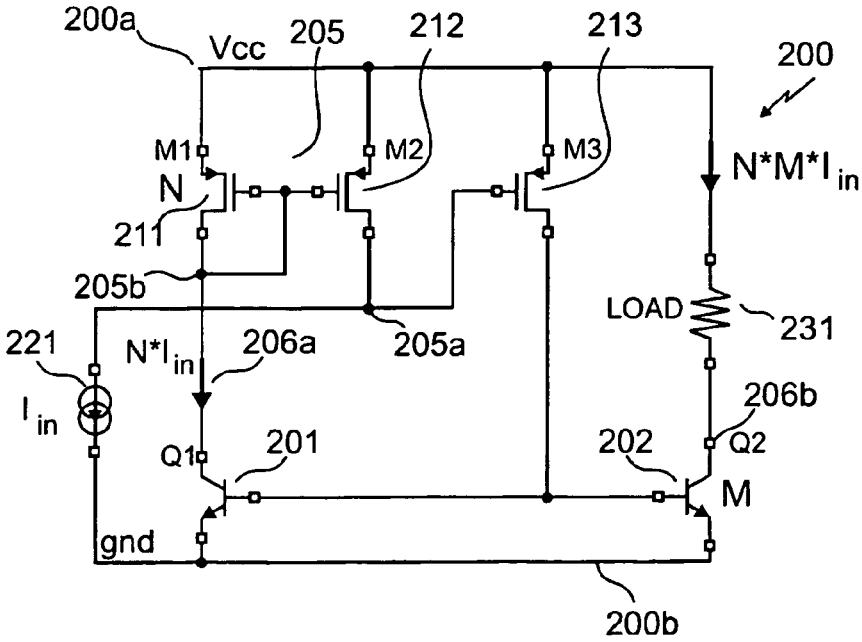
FIG. 2 illustrates a schematic of a wide ratio current mirror circuit in accordance with a first embodiment of the invention.

FIG. 2 illustrates a schematic of a wide ratio current mirror circuit 200 in accordance with a first embodiment of the invention. The wide ratio current mirror circuit 200 comprises a first FET M1, a second FET M2, a third FET M3, a current sink 221 for sinking current Iin, a first bipolar transistor Q1 201, a second bipolar transistor Q2 202 and a load resistor 231. A first supply voltage port 200*a* is used for providing a positive supply voltage to the wide ratio current mirror circuit 200 and a second supply voltage port 200*b* is used for providing a negative, or ground, supply voltage to the wide ratio current mirror circuit 200.

A current mirror circuit 205 is formed from first and second transistors in the form of p channel FETs M1 211 and M2 212, respectively, which are coupled with their source terminals to the first supply voltage port 200*a*. The gate terminals of the p channel FETs M1 211 and M2 212 are coupled together, coupled to the drain terminal of FET M1 211, and further coupled to the first current mirror port 205*b*. A second current mirror port 205*a* is formed at the drain terminal of FET M2 212. FETs M1 211 and M2 212 are formed so as to provide a statistical match with a current ratio of N times. The current in the drain terminal of FET M1 211 is N times the current in the drain terminal of FET M2 212, which functions as a current reduction circuit.

Transistors Q1 201 and Q2 202 form a current ratioing circuit that includes a first portion disposed between the first current mirror port 205*b* and the second supply voltage port 200*b* and a second portion disposed between the first supply voltage port 200*a* and the second supply voltage port 200*b*, the second portion including a load current path that includes a load resistor 231. A current path is formed between the first supply voltage port 200*a* and the coupled base terminals of transistors Q1 201 and Q2 202. The current path includes a FET M3 213, with source and drain terminals disposed in series with the current path from the first supply voltage port 200*a* to coupled base terminals of transistors Q1 201 and Q2 202. The gate terminal of FET M3 213 is coupled with the second current mirror port 205*a*. Transistors Q1 201 and Q2 202 are formed so as to provide a statistical match with M times current ratio. The current flowing in the collector terminal of transistor Q2 202 is M times the current flowing in the collector terminal of transistor Q1 201. For the load current path, resistor 231 is disposed between the current ratio output port 206*b* and the first supply voltage port 200*a*.

In equilibrium the drain current of FET M2 212 exactly balances the current Iin sinked through the current sink 221 and the potential on the drain terminal of FET M2 212 biases the gate terminal of FET M3 213. This causes current flow in the drain terminal of FET M3 213, which drives the base terminals of transistors Q1 201 and Q2 202. The resultant collector current in transistor Q1 201 drives the first current mirror port 205*b* and causes current to flow in the drain terminal of FET M2 212. By making FET M1 211 N times wider than FET M2 212 the current flowing in the collector terminal of Q1 201 is N times larger than the current flowing in the drain terminal of FET M2 212. By making transistor Q2 202 M times larger than transistor Q1 201 the current flowing in the collector terminal of Q2 202 is M times larger than the current flowing in the collector terminal of transistor Q1 201. Thus, the current propagating through the load resistor 231 is M*N*Iin. Advantageously, FET devices, M1 211 and M2 212, have longer channels and have sufficient gate area to provide the statistical match, whereas FET M3 213 is a short channel device.

Just as in the prior art, the limit on the ratio M of the two bipolar transistors Q1 201 and Q2 202 is about 20 or 40 to one. However by use of the FET mirror of M1 211 and M2 212 the overall current gain of the circuit is extended by N times.

Figure 3:
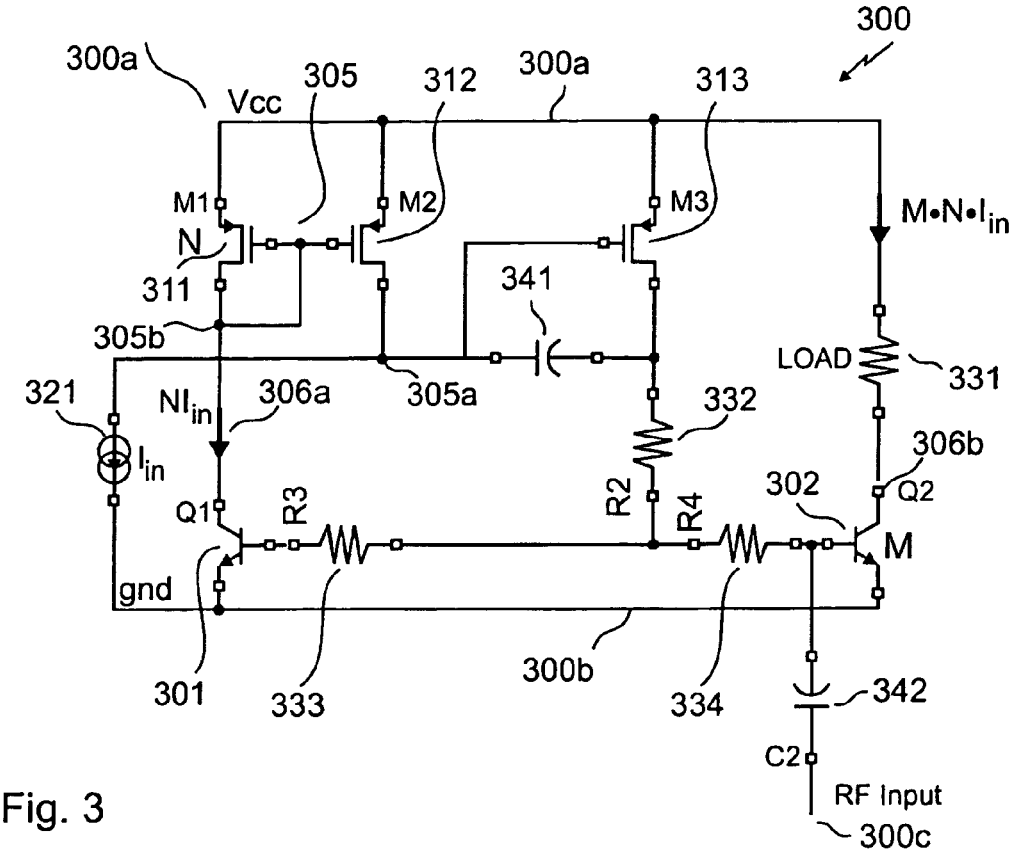
FIG. 3 illustrates an implementation of a wide ratio current mirror circuit, in accordance with a second embodiment of the invention, for use with a power amplifier (PA) stage; and, FIGS. 4*a* and 4*b* illustrates an implementation of a variation of the wide ratio current mirror circuit for use with a differential RF input signal, in accordance with third and fourth embodiments of the invention.

FIG. 3 illustrates an implementation of a wide ratio current mirror circuit 300, in accordance with a second embodiment of the invention, for use in receiving of an RF input signal through a RF signal input port 300*c*. The wide ratio current mirror circuit 300 comprises a first transistor, in the form of a first FET M1 311, a second transistor, in the form of a second FET M2 312, a fifth transistor, in the form of a third FET M3 313, a first current sink 321 for sinking current Iin, a third transistor, in the form of a first bipolar transistor Q1 301, a fourth transistor, in the form of a second bipolar transistor Q2 302, a load resistor 331, resistors R2 332 R3 333 R4 334, and capacitors 342 and 341. A first supply voltage port 300*a* is used for providing a positive supply voltage to the wide ratio current mirror circuit 300 and a second supply voltage port 300*b* is used for providing a negative, or ground, supply voltage to the wide ratio current mirror circuit 300.

A current mirror 305 is formed from FETs M1 311 and M2 312. The source terminals of the p channel FETs M1 311 and M2 312 are coupled to the first supply voltage port 300*a*. The gate terminals of the p channel FETs M1 311 and M2 312 are coupled together, coupled to the drain terminal of FET M1 311, and further coupled to the collector terminal of transistor Q1 301. A source terminal of FET M3 313 is coupled to the first supply voltage port 300*a*, with the gate terminal thereof coupled to the drain terminal of FET M2 312. A first current mirror port 305*a* is formed at the drain terminal of FET M2 312 and a second current mirror port 305*b* is formed at the drain terminal of FET M1 311.

Transistors Q1 301 and Q2 302 form a current ratioing circuit that includes a first portion disposed between the second current mirror port 305*b* and the second supply voltage port 300*b* and a second portion disposed between the first supply voltage port 300*a* and the second supply voltage port 300*b*, the second portion including a load current path that includes a load resistor 331. A current path is formed between the first supply voltage port 300*a* and the coupled base terminals of transistors Q1 301 and Q2 302. The current path includes the FET M3 313 and resistor R2 332 with source and drain terminals disposed in series with resistor R2 332 from the first supply voltage port 300*a* to coupled base terminals of transistors Q1 301 and Q2 302. The gate terminal of FET M3 313 is coupled with the first current mirror port 305*a*. Transistors Q1 301 and Q2 302 are formed so as to provide a statistical match with M times current ratio. The current flowing in the collector terminal of transistor Q2 302 is M times the current flowing in the collector terminal of transistor Q1 301. For the load current path, resistor 331 is disposed between the current ratio output port 306*b* and the first supply voltage port 300*a*. The base terminal of transistor Q1 301 is coupled with the base terminal of transistor Q2 302 through resistors R3 333 and R4 334 in series. A node is formed between resistors R3 333 and R4 334 is coupled with resistor R2 332 to the drain terminal of FET M3 313. The current sink 321 for sinking current Iin is disposed between the second supply voltage port 300*b* and the gate and drain terminals of FET M2 312 and the gate terminal of FET M3 313, respectively.

A capacitor 341 is disposed between the gate and drain terminals of FET M3 313. Capacitor C2 342 is disposed between the RF input port 300*c* and the base terminal of transistor Q2 302 for capacitively coupling of the RF input signal thereto, where transistor Q2 302 is modulated through capacitor C2 342 by the RF input signal. Resistor R4 334 provides a DC potential to the base terminal of transistor Q2 302, where resistor R3 333 provides a similar DC potential to the base terminal of transistor Q1 301. Capacitor 341 provides loop stabilization for FET M3 313 and resistor R2 332 aids in a pole split for the wide ratio current mirror circuit 300. Resistor R2 332 is used to isolate FET M3 313 from the resistively coupled base terminals of transistors Q1 301 and Q2 302. A voltage drop across resistor R3 333 matches the voltage drop across resistor R4 334.

Miller feedback within the circuit is a result of the dominant pole formed by FET M3 313. A small change in current of FET M3 reflects back to it's gate terminal through capacitor 341, where resistor R2 332 and capacitor 341 operate in conjunction as a voltage swing reduction circuit to reduce large voltage swings on the gate terminal of FET M3 313. Opposite to that, which is provided by the prior art illustrated in FIG. 1, which provides no stabilization correction.

In equilibrium, the drain current of FET M2 312 balances the current Iin sinked from the current sink 321 and the potential on the drain of FET M2 312 biases the gate terminal of FET M3 313. This causes current flow in the drain terminal of FET M3 313, which drives the base terminals of transistors Q1 301 and Q2 302. The resultant collector terminal current in transistor Q1 301 drives the second current mirror port 305*b*, through the first current ratio port 306*a*, and causes current to flow in the drain terminal of FET M2 312. By making FET M1 311 N times wider than FET M2 312 the current in the collector terminal of transistor Q1 301 is N times larger than the current in the drain terminal of FET M2 312. By making transistor Q2 302 M times larger than transistor Q1 301 the current in the collector terminal of transistor Q2 302 is M times larger than the current in the collector terminal of transistor Q1 301. Thus, the mean current propagating through the load resistor, 331 from the second ratio output port 306*b*, is M*N*Iin when there is no RF modulation provided to the circuit via the RF input port 300*c*.

Optionally, when the circuit components that comprise the wide ratio current mirror circuit 300 are integrated on a semiconductor substrate and the process offers particularly high NPN beta for the transistors Q1 301 and Q2 302, it may be advantageous to add a forward biased diode (not shown) from the node formed at the junction of resistors R2 332, R3 333 and R4 334 down to the second supply voltage port 300*b* in order to provide stability. This is implemented where the overall ratio of current output at the second current ratio output port 306*b* to current sinked (Iin) from current sink 321 is less than a DC current gain of the bipolar transistors Q1 301 and Q2 302. Under this condition the current flowing in the drain terminal of FET M3 313 is less than the sinked current Iin and the pole splitting action of 341 does not occur. The addition of the diode increases the current draw from the drain terminal of FET M3 313. This addition of the forward biased diode is optionally implemented in all embodiments of the invention in order to reduce the impedance at the junction of resistors R2 332, R3 333 and R4 334, thereby improving the effectiveness of the pole splitting of capacitor 341.

For example, the wide ratio current mirror circuit 300 shown in FIG. 3 is for being used in conjunction with a PA output stage in a DECT, which is a digital wireless technology known to those of skill in the art.

Further optionally, PNP transistors can be used instead of FETs M1 311 and M2 312 and optionally FET M3 313. However, this is less desirable, especially for FET M3 313, because bipolar transistors, unlike FETs, have finite current gain.

Advantageously, the first and second embodiments of the invention provide significant improvements in precision in output current for a low voltage PA without incurring an overhead of quiescent current. Furthermore, the second embodiment of the invention 300 utilizes the voltage swing reduction circuit in order to provide stability thereto. Additionally, the embodiments of the invention offer a wide ratio current mirror circuit that provides an output current that is a multiple of already multiplied current, which is advantageous over that attainable in the prior art.

Figure 4A:
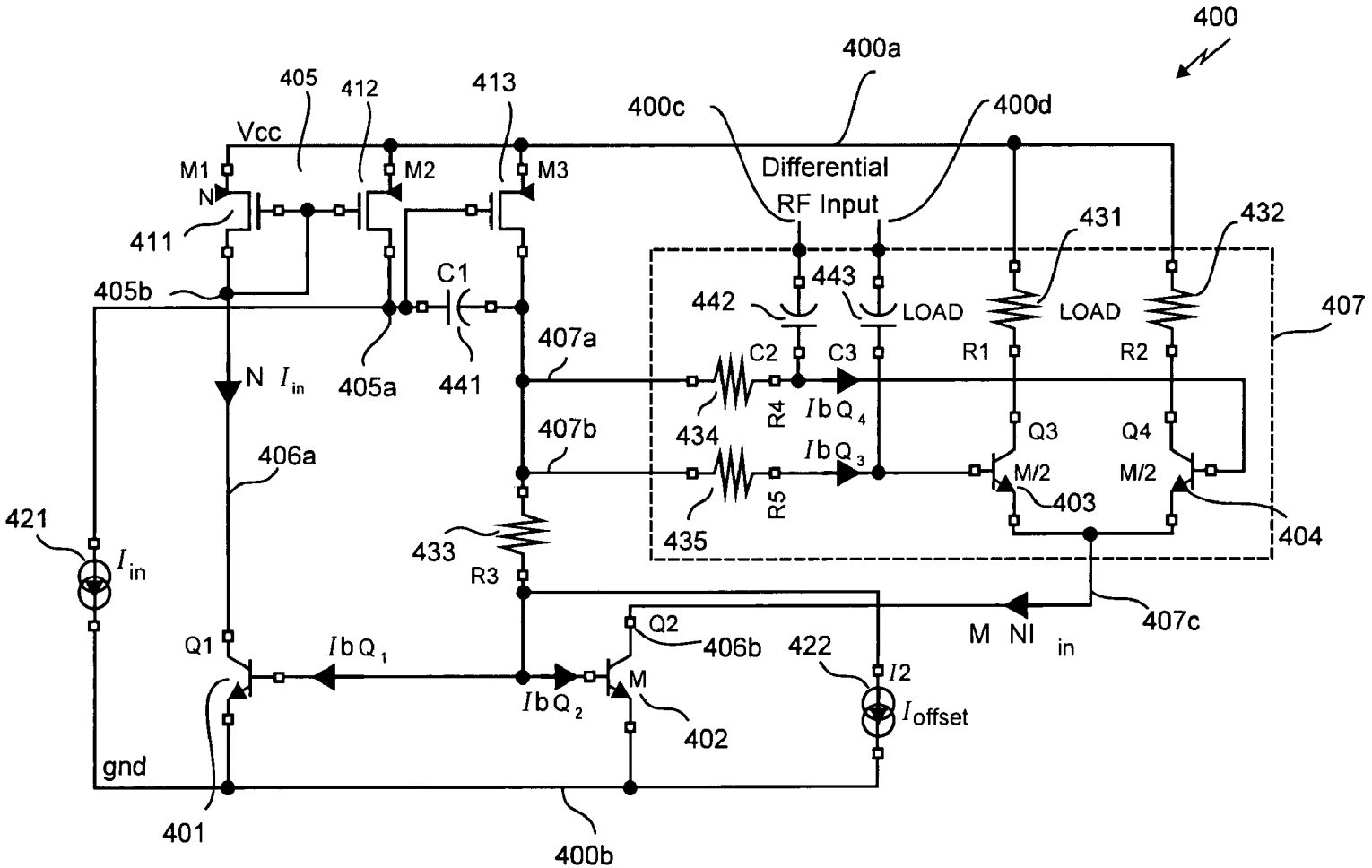
Figure 4B:
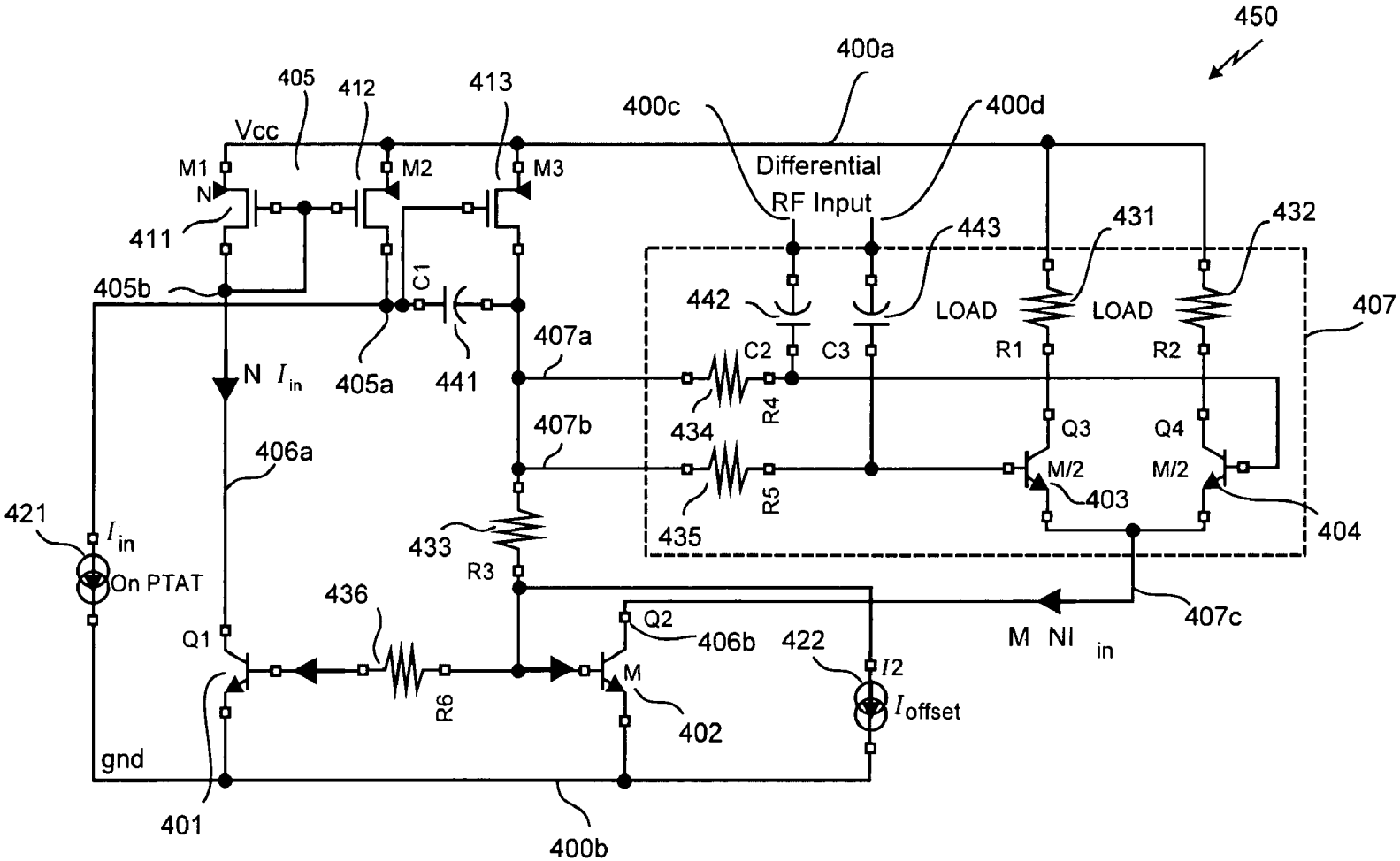

FIGS. 4*a* and 4*b* illustrates an implementation of a variation of the wide ratio current mirror circuit 200 for use with a differential RF input signal, in accordance with third 400 and fourth 450 embodiments of the invention. A first supply voltage port 400*a* is used for receiving a positive supply voltage, a second supply voltage port 400*b* is used for receiving a negative, or ground, supply voltage. Differential RF input ports, 400*c* and 400*d*, are disposed for receiving of a differential RF input signal.

Transistors Q1 401 and Q2 402 form a current ratioing circuit that includes a second portion disposed between the first current mirror port 405*b* and the second supply voltage port 400*b* and a first portion disposed between the first supply voltage port 400*a* and the second supply voltage port 400*b*, the first portion including a load current path that includes a load resistor 431. A current path is formed between the first supply voltage port 400*a* and the coupled base terminals of transistors Q1 401 and Q2 402. The current path includes the FET M3 413 and the resistor R3 433, with source and drain terminals disposed in series with resistor R3 433 along the current path from the first supply voltage port 400*a* to coupled base terminals of transistors Q1 401 and Q2 402. The gate terminal of FET M3 413 is coupled with the second current mirror port 405*a*. Transistors Q1 401 and Q2 402 are formed so as to provide a statistical match with M times current ratio. The current flowing in the collector terminal of transistor Q2 402 is M times the current flowing in the collector terminal of transistor Q1 401.

A first current mirror 405 is formed from FETs M1 411 and M2 412. Preferably, the FETs M1 411 and M2 412 are positive channel FETs (PFETs). The source terminals of the PFETs M1 411 and M2 412 are coupled to the first supply voltage port 400*a*. The gate terminals of the p channel FETs M1 411 and M2 412 are coupled together, coupled to the drain terminal of FET M1 411, and further coupled to the collector terminal of transistor Q1 401. A source terminal of FET M3 413 is coupled to the first supply voltage input 400*a*, with the gate terminal thereof coupled to the drain terminal of FET M2 412. A second current mirror port 405*a* is formed at the drain terminal of FET M2 412 and a first current mirror port 405*b* is formed at the drain terminal of FET M1 411.

The current sink 421, for sinking of current Iin, is disposed between the second supply voltage port 400*b* and the second current mirror port 405*a*. A node formed between transistors Q1 401 and Q2 402 is coupled to the drain terminal of FET M3 413 via resistor R3 433 disposed in series. Source and drain terminals of FET M3 413 form a current path from the first supply voltage port 400*a*, via resistor R3 433, to coupled base terminals of transistors Q1 401 and Q2 402. Capacitor C1 441 is disposed between the gate and drain terminals of FET M3 413 for providing loop stabilization for FET M3 413 and resistor R3 433 aids in a pole split for the circuits 400 and 450. Resistor R3 433 is used to isolate FET M3 413 from the coupled base terminals of transistors Q1 401 and Q2 402.

Miller feedback within the circuit is a result of the dominant pole formed by FET M3 413. A small change in current of FET M3 413 reflects back to its gate through capacitor C1 441, where resistor R3 433 and capacitor C1 441 operate in conjunction as a voltage swing reduction circuit to reduce large voltage swings on the gate terminal of FET M3 413. Opposite to that which is provided by the prior art illustrated in FIG. 1, which provides no stabilization correction.

In equilibrium the drain current of FET M2 412 balances the current Iin from the current sink 421 and the potential on the drain terminal of FET M2 412 biases the gate terminal of FET M3 413. This causes current flow in the drain terminal of M3 413, which drives the base terminals of transistors Q1 401 and Q2 402. The resultant collector current in transistor Q1 401 drives the first current mirror port 405*b* and causes current to flow in the drain terminal of FET M2 412. By making FET M1 411 N times wider than FET M2 412 the current in the collector terminal of transistor Q1 401 is N times larger than the current in the drain terminal of FET M2 412. By making transistor Q2 402 M times larger than transistor Q1 401 the current in the collector terminal of transistor Q2 402 is M times larger than the current in the collector terminal of Q1 401. Thus, the DC current propagating through the load, in the form of the differential amplifier 407, coupled between the second current ratio port 406*b* and the first supply voltage port 400*a*, is M*N*Iin, as shown. A second current source 422 is coupled to the base terminal of transistor Q2 402 and provides and offset current, Ioffset, thereto.

The differential amplifier 407 comprises a differential bias port 407*c* coupled with the second current ratio output port 406*b*, a first bias port 407*a*, a second bias port 407*b*, and first and second RF signal input ports 400*c* and 400*d* in the form of differential RF input ports. A differential pair of seventh and sixth bipolar transistors Q3 403 and Q4 404, respectively, is disposed with coupled emitter terminals and coupled with the differential bias port 407*c*. First and second load resistors, R1 431 and R2 432, are coupled in series between the collector ports of the seventh and sixth bipolar transistors Q3 403 and Q4 404, respectively, and the first supply voltage port 400*a*. A first bias resistor R4 434 is disposed between the first bias port 407*a* and the base terminal of transistor Q4 404. A second bias resistor R5 435 is disposed between the second bias port 407*b* and the base terminal of transistor Q3 403. The first and second bias ports, 407*a* and 407*b*, are coupled to the drain terminal of FET M3 413. A second capacitor C2 442 couples the first RF input port 400*c* to the base terminal of transistor Q4 404. A third capacitor C3 443 couples the second RF input port 400*d* to the base terminal of transistor Q3 403.

Base terminal bias for transistors Q3 403 and Q4 404 is offset above the base terminal bias for transistor Q2 402 by the second current source 422 coupled to the base terminal of transistor Q2 402. Preferably transistor Q2 402 operates as close to saturation as possible in order to maximize the potential difference that is available to load, in the form of the differential amplifier 407.

In the third embodiment of the invention 400, the bipolar transistor devices, Q1 401 Q2 402 Q3 403 and Q4 404, are fabricated on a same semiconductor substrate with a similar construction and manufacturing process so that they have closely matching electrical characteristics. Thus, in an ideal situation, the base current (IbQ2) propagating into transistor Q2 402 matches the combined base current propagating into transistor Q3 403 (IbQ3) and into transistor Q4 404 (IbQ4).

The voltage drop (VdropR3) across resistor R3 433 is provided by equation (1):

$$V\text{drop}R3=(IbQ1+IbQ2+I\text{offset})*R3, \quad (1)$$

where IbQ1 is the base current propagating into transistor Q1 401 and IbQ2 is the base current propagating into transistor Q2 402. The voltage drop across resistor R3 433 is also expressed as equation (2):

$$V\text{drop}R3=(IbQ2(1+1/M)+I\text{offset})*R3 \quad (2)$$

By selecting resistor R3=R4(1+1/M)/2, the voltage drop across resistor R3 is matched to the voltage drops across resistors R4 434 or R5 435 due to the base currents IbQ3 and IbQ4. The voltage on the collector terminal of transistor Q2 402 is Ioffset*R3. In an actual implementation of the circuit 400, the Early voltage realized on the NPN transistors, 403 and 404, causes the base current propagating into transistors Q3 403 and Q4 404 to be slightly less than the base current propagating into transistor Q2 402. This difference is preferably corrected by a small reduction in the resistance of resistor R3 433.

Referring to FIG. 4*b*, a variant of the third embodiment 400 of the invention is shown as a fourth embodiment of the invention 450. In the fourth embodiment 450 the collector current of transistors 403 Q3 and 404 Q4 is preferably independent of the manufacturing process beta for the transistors and is preferably proportional to absolute temperature (PTAT). Additionally, a resistor R6 436 is disposed between the base terminals of transistors Q1 401 and Q2 402. This resistor R6 436 compensates for the process beta and sets the current in the collector terminals of transistors Q3 403 and Q4 404 independent of the beta. This type of implementation is preferable for use with low noise amplifier (LNA) circuits where a PTAT collector current gives a gain characteristic independent of temperature. In this embodiment, source and drain terminals of FET M3 413 form a current path from the first supply voltage port 400*a*, via resistor R3 433, to coupled base terminals of transistors Q1 401 and Q2 402.

In the third and fourth embodiments of the invention, 400 and 450, preferably resistor R3=R4(1+1/M)/2, thus providing beta compensation. Preferably transistor 401 Q1 is a small device in relation to transistor 402 Q2, which is much larger. Transistor Q2 402 does not operate at 0V, thus the second current source 422 provides Ioffset to resistor R3 433 in order to elevate the potential of transistor Q2 402 to approximately 300–400 mV above a potential of the second supply voltage port 400*b*. In order to not waste available voltage headroom, the second current source 422 preferably provides enough Ioffset to Q2 402 in order to facilitate operation thereof and no more. Preferably, the collector voltage of transistor Q2 402 is independent of supply voltage provided to the first supply voltage port 400*a*. Optionally, the second current source provides Ioffset independent of temperature. Advantageously, the third and fourth embodiments of the invention utilize the wide ratio current mirror 200, shown in FIG. 2, in order to provide precision bias to the load, in the form of the differential amplification stage 407.

For example, the circuits 400 and 450 shown in FIGS. 4*a* and 4*b* are for being used in conjunction with a differential PA output stage in a DECT, which is a digital wireless technology known to those of skill in the art.

Further optionally, the PNP transistors can be used to replace FETs M1 211, 311, 411 and M2 212, 312, 412 and optionally FET M3 213, 313, 413. However, this is less desirable, especially for FET M3 213, 313, 413, because bipolar transistors, unlike FETs, have finite current gain.

Numerous other embodiments may be envisaged without departing from the spirit or scope of the invention.

What is claimed is:

1. A circuit comprising:

a first supply voltage port;

a second supply voltage port;

a current mirror circuit comprising a first current mirror port and a second current mirror port, the second current mirror port for propagating an input current from the first supply voltage port to the second supply voltage port through the current mirror circuit coupled there between, where the first current mirror port is for providing N times the input current;

a current ratioing circuit comprising a first portion disposed between the first current mirror port and the second supply voltage port and a second portion disposed between the first supply voltage port and the second supply voltage port, the second portion comprising a load current path, where the current ratioing circuit is for propagating M times N times the input current through the load current path, wherein the first portion of the current ratioing circuit comprises a first bipolar transistor having a first base terminal, and one of a first collector terminal and first emitter terminal coupled with the first current mirror port, and the other of the first emitter terminal and the first collector terminal thereof coupled with the second supply voltage port, and wherein the second portion of the current ratioing circuit comprises a second bipolar transistor having a second base terminal coupled with the first base terminal, and one of a second collector terminal and second emitter terminal coupled to the load current path, and the other of the second emitter terminal and the second collector terminal thereof coupled with the second supply voltage port, wherein the second bipolar transistor is M times larger than the first bipolar transistor;

a bias current path disposed between the first supply voltage port and the coupled first and second base terminals for propagating current therein in response to the input current; and wherein at least one of N and M is other than 1.

2. A circuit according to claim 1 comprising a current sink coupled between the second supply voltage port and the second current mirror port for sinking the input current through the current mirror circuit from the second current mirror port to the second supply voltage port.

3. A circuit according to claim 2 comprising a first current source coupled to the first and second base terminals of the first and second bipolar transistors for providing an offset current thereto.

4. A circuit according to claim 3 wherein, in use of the circuit, a potential difference is realized between the second collector and second emitter terminals of the second bipolar transistor of approximately 300–400mV in response to the offset current.

5. A circuit according to claim 3 comprising a RF input port formed at the second base terminal of the second bipolar transistor for receiving of a RF input signal.

6. A circuit according to claim 1 wherein each of N and M are other than 1.

7. A circuit according to claim 1 wherein the second portion of the current ratioing circuit comprises a plurality of second bipolar transistors having a plurality of second base terminals coupled with the first base terminal, and one of a plurality of second collector terminals and a plurality of second emitter terminals coupled to the load current path, and the other of the plurality of second emitter terminals and the plurality of second collector terminals thereof coupled with the second supply voltage port, wherein the plurality of second bipolar transistors disposed together in parallel are M times larger than the first bipolar transistor.

8. A circuit according to claim 1 wherein the bias current path comprises a first field effect transistor (FET) having a first gate terminal, a first drain terminal and a first source terminal disposed in series along the bias current path, the first gate terminal coupled with the second current mirror port for controlling propagation of the current between the first source and drain terminals in dependence upon the input current.

9. A circuit according to claim 8 wherein the current mirror circuit further comprises:

a second FET having a second gate terminal, a second drain terminal and a second source terminal, the second source and second drain terminals disposed in series between the first supply voltage port and the second current mirror port, the drain terminal of the second FET being coupled to the first base terminal.

10. A circuit according to claim 9 wherein the current mirror circuit further comprises:

a third FET having a third gate terminal, a third drain terminal and a third source terminal, the third source and third drain terminals disposed in series between the first supply voltage port and the first current mirror port with one of the third drain and third source terminals coupled with the third gate terminal, wherein the third FET is N times wider than the second FET.

11. A circuit according to claim 10 wherein at least one of the first FET, the second FET, and the third FET is a PFET.

12. A circuit according to claim 8 comprising a loop stabilization circuit comprising a first capacitor disposed between the first drain and first gate terminals of the first FET; and, a first resistor disposed between the first drain terminal of the first FET and coupled to a node formed between the first and second base terminals of the first and second bipolar transistors.

13. A circuit according to claim 12 comprising second and third resistors disposed between the first base terminal and the node and the second base terminal and the node, respectively.

14. A circuit according to claim 8 wherein the load current path comprises a differential amplification stage disposed in series between the first supply voltage port and one of the second collector and second emitter terminals of the second bipolar transistor.

15. A circuit according to claim 14 wherein the differential amplification stage comprises:

first and second bias ports coupled to one of the first drain and first source terminals of the first FET;

a differential bias port coupled to one of the second collector and second emitter terminals of the second bipolar transistor;

a first RF signal input port for receiving a first RF input signal; and, a second RF signal input port for receiving of a second RF input signal, where the first and second RF signal input ports are for, in combination, receiving of a differential RF input signal.

* * * * *